United States Patent [19]

Grusin

[11] 4,011,672

[45] Mar. 15, 1977

[54] MOUNTING FRAME

[75] Inventor: Gerald M. Grusin, Chicago, Ill.

[73] Assignee: Dart Industries Inc., Los Angeles, Calif.

[22] Filed: Nov. 12, 1975

[21] Appl. No.: 631,291

[52] U.S. Cl. ..... 40/16.2; 40/152.1

[51] Int. Cl.[2] ..... G09F 3/18

[58] Field of Search ..... 40/16, 16.2, 10 R, 152.1, 40/63 A, 64 A

[56] References Cited

UNITED STATES PATENTS

| | | | |
|---|---|---|---|
| 1,638,761 | 8/1927 | Dieudonne | 40/152.1 X |
| 3,074,194 | 1/1963 | Mapson | 40/16.2 |
| 3,337,977 | 8/1967 | Subesky | 40/16.2 X |

*Primary Examiner*—Louis G. Mancene
*Assistant Examiner*—John H. Wolff
*Attorney, Agent, or Firm*—Leigh B. Taylor; Kenneth J. Hovet; Paul R. Wylie

[57] ABSTRACT

A mounting frame positionable on a rigid surface as desk, table or the like, and adapted to mount photographs, decorative articles, a calendar or the like. This frame comprises triangular-like shaped end walls, a first side wall connecting the end walls, a second side wall substantially parallel to the first side wall and extending between and connecting the end walls. An additional central wall extends between and is attached to the end walls and is located between the two side walls. A clear sheet of flexible plastic material, or a clear sheet of plastic material having certain areas masked off to provide clear openings in the plastic sheet, is inserted between the end and side walls and flexed inwardly against the central wall so that the sheet has a concave configuration. This concave configuration substantially matches the top edge of the end walls which have a concave configuration. A suitable ridge means form part of the first and second side walls so that the flexible plastic sheet is held in position in a concave configuration. Photographs, other decorative materials, such as dried flowers, or a calendar are positioned behind the plastic sheet prior to the time that it is flexed inwardly against the central wall. Thus the photographs or the decorative material or calendar is held firmly in place for easy viewing. The holder has two different positions in which it can be placed on a rigid surface or it may be mounted on a wall.

4 Claims, 12 Drawing Figures

MOUNTING FRAME

BACKGROUND OF THE INVENTION

1. Field of the Invention

The present invention relates to a holder or frame for mounting photographs, other decorative materials, calendars or the like.

2. Description of the Prior Art

In general, the prior art includes conventional frames fabricated from various materials of a rectangular or square shape. Normally, a plastic or glass sheet is inserted in the frame in front of the picture to be mounted in the frame and a backing is attached behind the picture. Some frames are available which permit the flexing of the picture to create a 3-dimensional effect.

In addition, the prior art includes price tag holders which can be flexed and fitted in the frame for displaying a price number in stores.

The advantage of the present invention is that it is a highly decorative multipositionable holder which permits the insertion and removal of pictures or decorative material easily and rapidly and the picture is flexed to a concave position to give a 3-dimensional effect.

SUMMARY OF THE INVENTION

The present invention provides a holder for pictures, calendars or other decorative material of such construction that the material held in the holder may be rapidly and easily changed. In addition, a flexible plastic sheet is placed over the material in the holder and flexed to a concave configuration to give a 3-dimensional effect and to provide an esthetically appealing view of the material in the holder.

DESCRIPTION OF THE PREFERRED EMBODIMENT

Figure 1:
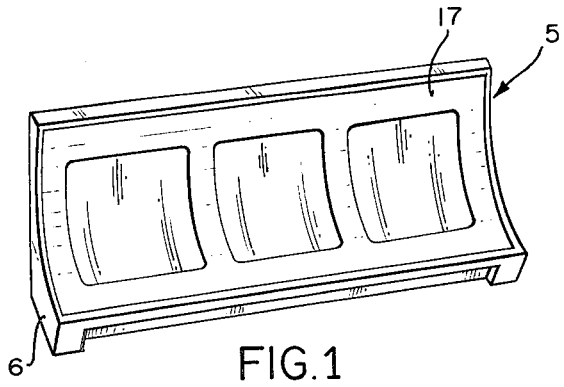
FIG. 1 is a front perspective view of the holder of the present invention, with the holder positioned in a first viewing position.
Figure 2:
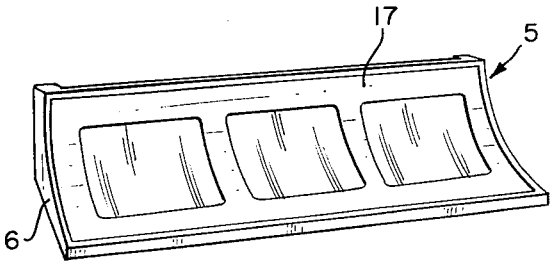
FIG. 2 is a front perspective view of the holder with the holder positioned in a second viewing position.

The preferred embodiment of the mounting frame 5 is shown in a first display position in FIG. 1 and in a second display position in FIG. 2. The display position in FIG. 1 results in the holder standing higher than the display position shown in FIG. 2. In FIG. 2 the holder has its longest end wall dimension along the support on which it is resting.

The holder includes a pair of preferably parallel end walls 6 and 7. The end walls are identical in configuration and have somewhat of a right angle triangular-like appearance. The outer edge 8 of each end wall 6 and 7 is the apex of the triangle and is somewhat truncated. Each end wall has a longer side 9 and a shorter side 10. The upper edge of each end wall is curved (concave) at 11 on approximately a 4½ inch radius. Each end wall has a longer straight edge 9 which is approximately 5 inches long and the shorter straight edge 10 which is approximately 2½ inches long. The length of the holder is approximately 12 inches. The inclusion of these dimensions is not intended to limit this invention or the size of the holder, but rather to show the relative relationship of the dimensions of the holder.

Figure 7:
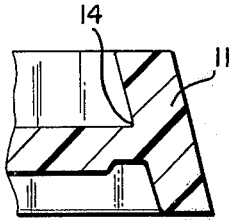
FIG. 7 is an enlarged view of circled portion 7 in FIG. 5.

A front wall 11 extends between and is affixed to each of the two end walls 6 and 7. This front wall is relatively short in height and is sloped or canted inwardly as shown in FIG. 7.

Figure 4:
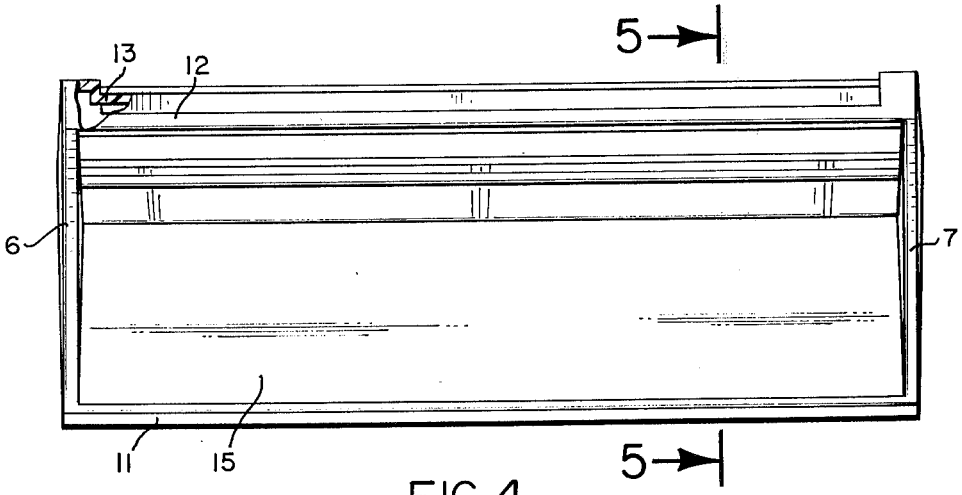
FIG. 4 is a top plan view of the holder with parts cut away.
Figure 5:
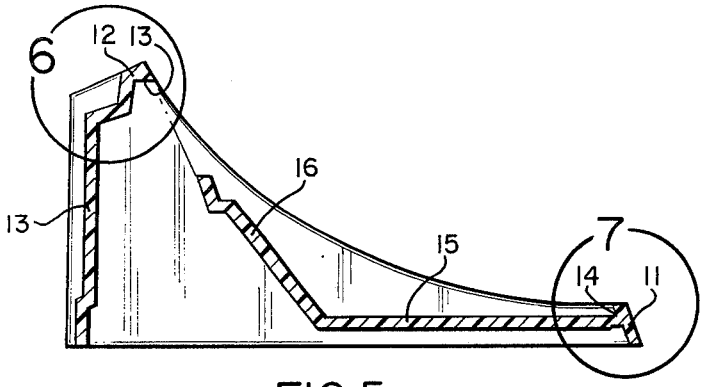
FIG. 5 is a cross-sectional view taken on line 5—5 of FIG. 4.
Figure 6:
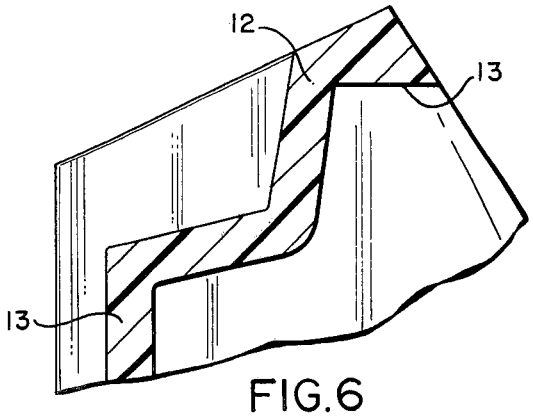
FIG. 6 is an enlarged view of circled portion 6 in FIG. 5.

The upper end of the holder has a wall 12 extending between and affixed to each of the two end walls 6 and 7. The wall 12 has the configuration shown in FIG. 6. A back wall 13 extends downwardly from the top wall 12 in the configuration shown in FIG. 5 and the cut out portion shown in FIG. 4. A portion of the top wall 12 extends parallel to the bottom edge 9 of the holder in the area 13 designed for purposes to be discussed hereinafter. The front wall 11 provides an undercut area 14 at the rear of the wall due to the manner in which the wall 11 is slanted. A central wall 15 extends rearwardly from the wall 11 in the manner shown in FIG. 5 and has an upwardly projecting portion 16. The walls 15 and 16 extend between and are affixed to the end walls 6 and 7.

A flexible plastic sheet 17 is also provided with the holder 5 and may be fabricated from any flexible clear plastic such as acrylic, polystyrene or the like. This flexible sheet is normally provided with clear windows 19. Thus the darkened area 18 forms a mask for a photograph which is inserted in the holder in the manner to be described hereinafter. The clear areas 19 may be of any configuration such as rectangular, square, oval and may be of any number depending upon the desires of the user. In addition, the plastic sheet 17 may be entirely clear without any darkened masking areas 18 if the user desires to display a plurality of photographs which will fill the entire area behind the plastic sheet 17.

Figure 8:
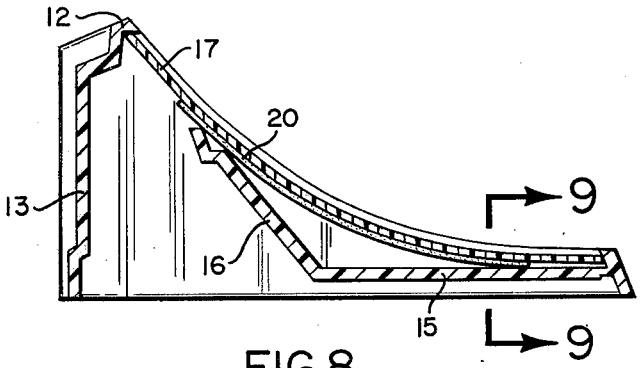
FIG. 8 is a cross-sectional view similar to FIG. 5 and showing the holder in assembled condition with a picture and the flexible plastic sheet in place.
Figure 9:
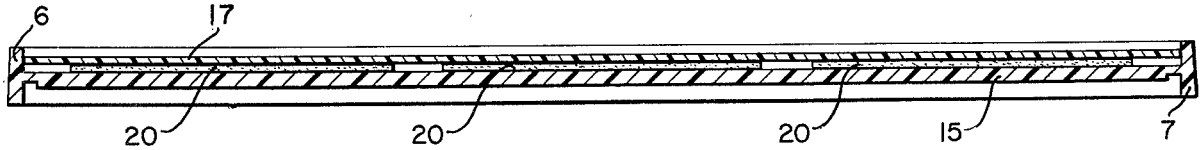
FIG. 9 is a cross-sectional view taken on line 9—9 of FIG. 4.
Figure 10:
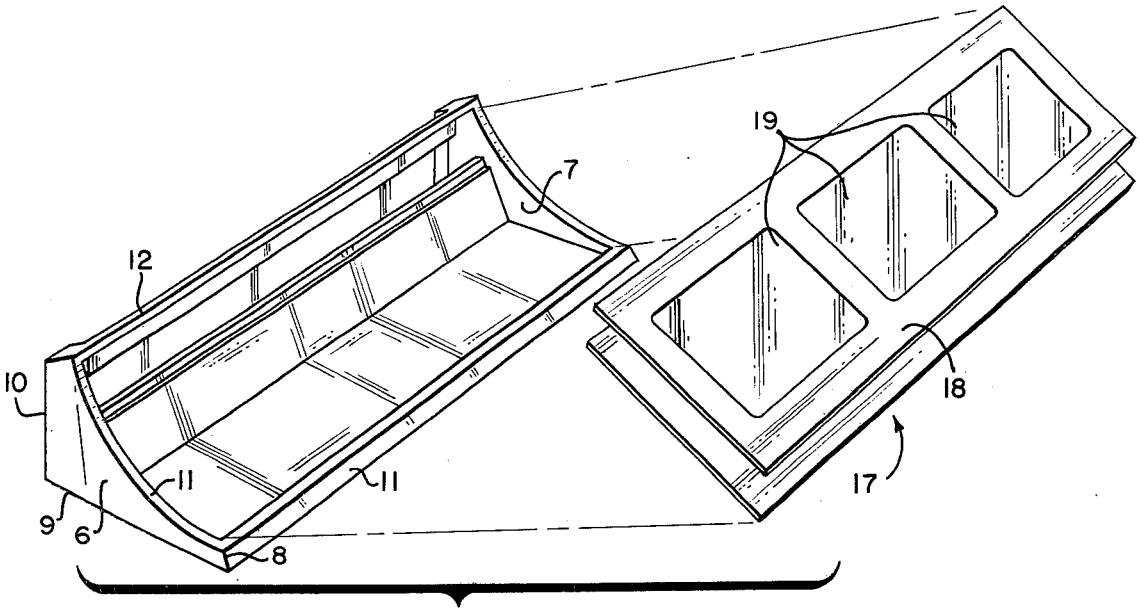
FIG. 10 is an exploded perspective view of another embodiment of the holder.
Figure 11:
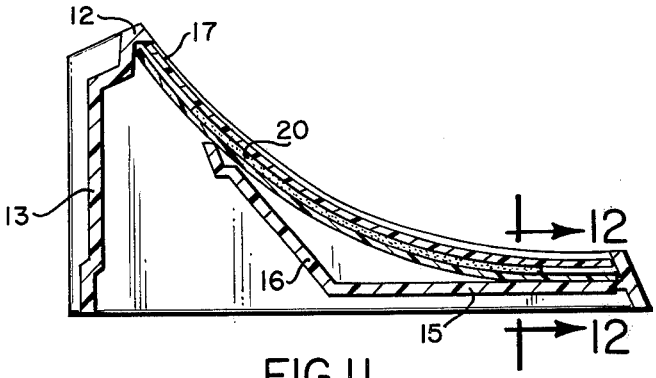
FIG. 11 is a cross-sectional view similar to FIG. 8 and showing the holder of FIG. 10 in assembled condition with a picture and the flexible plastic sheets in place; and, FIG. 12 is a cross-sectional view taken along line 12—12 of FIG. 11.
Figure 12:
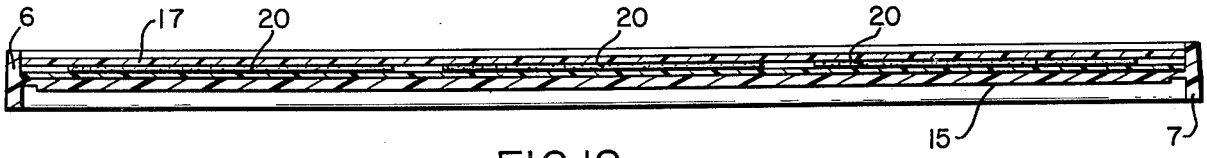

Referring now to FIGS. 8 and 9, a photograph 20 is shown in position behind the clear plastic sheet 17 which has masking areas 18. The sheet 17 is flexed inwardly after insertion of its upper edge underneath the edge 13 of wall 12 and into the undercut 14 of wall 11. The flexible sheet 17 is of sufficient flexibility to easily snap to the concave shape shown in FIG. 8 and substantially conforms with the concave edges 11 of the end walls 6 and 7, but has sufficient rigidity to hold the photograph 20 in position against the wall 16.

Other decorative materials, such as dried flowers, could also be placed in the holder. A decorative item such as dried flowers would require a backing sheet similar to the photograph 20 to hold them in proper position. In the event that the photograph or other material is not in proper position behind the flexible sheet 17, it may be manually adjusted by the user inserting his fingers between the upper edge of wall 16 and wall 12 and manually adjusting the photograph or the like.

Figure 3:
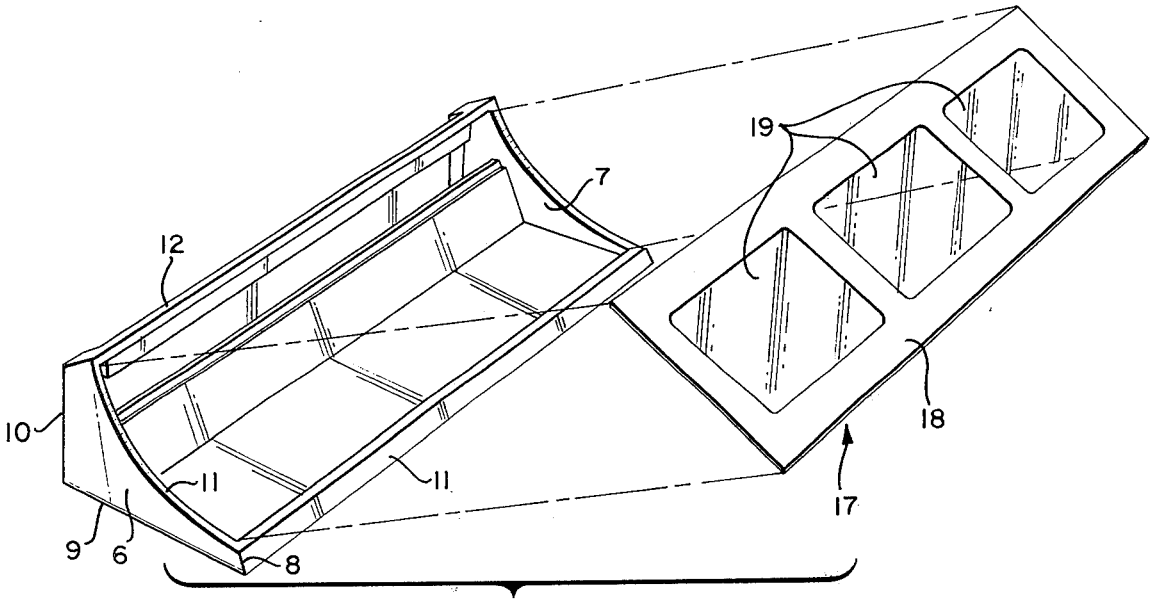
FIG. 3 is an exploded perspective view of the holder.

While I refer to upper edges and lower edges throughout this specification, it is understood that the holder can be used either of two positions as shown in FIGS. 1 and 2, and such references refer to the holder when in the position shown in FIGS. 2 and 3.

The sheet 17 may be repeatedly removed by merely flexing it outwardly from its concave position by inserting the fingers into the opening between wall 16 and wall 12, thus permitting a rapid and easy change in the photograph or decorative material which is positioned in the holder.

An alternative way of using the holder is to position a second flexible sheet behind the photograph so that the photograph is encapsulated between two flexible sheets and both sheets are simultaneously flexed inwardly to the concave position shown in FIG. 8. This provides a more sturdy retention of the photograph or decorative materials positioned in the holder.

While I have described a preferred embodiment of my invention, it may be otherwise embodied in alternative forms to perform the same function and achieve the same results within the scope of the following claims.

I claim:

1. A holder for photographs or the like comprising spaced end walls of a triangular-like configuration each having a long edge and a short edge, creating respectively an apex and a base at their intersection with the approximate hypothenuse, which hypothenuse is concave, a first side wall affixed to the apex of each end wall, a second side wall affixed to the base of each end wall, an undercut extending along the inner side of each of said first and second side walls, a third wall affixed to and extending between said end walls, and located between said first and second side walls, a flexible sheet of a size to fit snugly between said end walls and the first and second side walls, opposite edges of the sheet being positioned in each of said undercuts, said sheet being flexed inward in a concave configuration against said third wall, and the photographs or the like being positioned between and held in place by said sheet and said third wall whereby the holder may be placed in use in either of two positions: first residing on said long edge, or, second residing on said short edge.

2. A holder according to claim 1 wherein an opening is provided in said third wall whereby the photographs or the like are accessible to manual hand manipulation.

3. A holder according to claim 1 wherein a second flexible sheet is positioned behind the photographs or the like and is flexed toward the third wall to a concave configuration.

4. A holder according to claim 1 wherein said flexible sheet incorporates certain opaque and translucent areas.

* * * * *